US008658930B2

(12) United States Patent
Shang

(10) Patent No.: US 8,658,930 B2
(45) Date of Patent: Feb. 25, 2014

(54) EMBEDDED POLE PART WITH AN ISOLATING HOUSING MADE OF THERMOPLASTIC MATERIAL

(75) Inventor: Wenkai Shang, Ratingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/354,713

(22) Filed: Jan. 20, 2012

(65) Prior Publication Data

US 2012/0175346 A1 Jul. 12, 2012

Related U.S. Application Data

(63) Continuation of application No. PCT/EP2010/004396, filed on Jul. 19, 2010.

(30) Foreign Application Priority Data

Jul. 20, 2009 (EP) ..... 09009396

(51) Int. Cl.
*H01H 33/66* (2006.01)

(52) U.S. Cl.
USPC ..... 218/119; D13/160

(58) Field of Classification Search
USPC ..... 218/118–121; D13/160
See application file for complete search history.

(56) References Cited

U.S. PATENT DOCUMENTS

| | | | | |
|---|---|---|---|---|
| 4,527,028 | A * | 7/1985 | Luehring | 218/119 |
| 4,618,749 | A | 10/1986 | Bohme et al. | |
| 5,808,258 | A | 9/1998 | Luzzi | |
| 6,335,502 | B1 * | 1/2002 | Kikukawa et al. | 218/118 |
| D556,696 | S * | 12/2007 | Ruemenapp | D13/158 |
| D558,147 | S * | 12/2007 | Ruemenapp | D13/158 |
| D558,149 | S * | 12/2007 | Ruemenapp | D13/160 |
| 2009/0200270 | A1 * | 8/2009 | Chen et al. | 218/119 |
| 2010/0170774 | A1 | 7/2010 | Einschenk et al. | |
| 2010/0246102 | A1 | 9/2010 | Martin et al. | |

FOREIGN PATENT DOCUMENTS

| | | | |
|---|---|---|---|
| DE | 2320744 | A1 | 11/1974 |
| DE | 2610440 | A1 | 9/1977 |
| DE | 102007028205 | A1 | 12/2008 |
| DE | 102007041971 | A1 | 3/2009 |
| EP | 0485306 | A1 | 5/1992 |
| FR | 1428094 | A | 2/1966 |
| FR | 2628258 | A1 | 9/1989 |
| FR | 2920251 | A1 | 2/2009 |
| FR | 2925755 | A1 | 6/2009 |

OTHER PUBLICATIONS

International Search Report (PCT/ISA/210) issued on Sep. 15, 2010, by European Patent Office as the International Searching Authority for International Application No. PCT/EP2010/004396.

(Continued)

*Primary Examiner* — Truc Nguyen
(74) *Attorney, Agent, or Firm* — Buchanan Ingersoll & Rooney PC

(57) ABSTRACT

An embedded pole part is provided with an isolating housing made of thermoplastic material. The housing embeds an interrupter as well as the electric terminals of the pole part. At an outer surface of the housing, horizontal and/or vertical aligned three-dimensional structures joined by material engagement are implemented into the thermoplastic material, to achieve a higher mechanical stiffness as well as higher creepage length of the pole part. The mechanical and dielectric parameters of the pole part are thereby strengthened, for example, in the case of a short circuit current.

25 Claims, 4 Drawing Sheets

(56) References Cited

OTHER PUBLICATIONS

International Search Report (PCT/ISA/210) issued on Sep. 21, 2010, by European Patent Office as the International Searching Authority for International Application No. PCT/EP2010/004397.

B. Fenski et al., Vacuum interrupters and embedded poles for medium voltage, etz publication translated by ABB, Mar. 2007.

U.S. Office Action issued on May 7, 2013 in related U.S. Appl. No. 13/354,761.

* cited by examiner

EMBEDDED POLE PART WITH AN ISOLATING HOUSING MADE OF THERMOPLASTIC MATERIAL

RELATED APPLICATION

This application claims priority as a continuation application under 35 U.S.C. §120 to PCT/EP 2010/004396, which was filed as an International Application on Jul. 19, 2010 designating the U.S., and which claims priority to European Application 09009396.4 filed in Europe on Jul. 20, 2009. The entire contents of these applications are hereby incorporated by reference in their entireties.

FIELD

The present disclosure relates to an embedded pole part with an isolating housing made of thermoplastic material, which embeds a vacuum interrupter as well as the electric terminals of the pole part.

BACKGROUND INFORMATION

For embedded pole parts, it is important to strengthen the pole part mechanically in such a way that it is strong enough to withstand a short circuit current. Furthermore, it should be able to withstand mechanical stress when fixing the vacuum interrupter in the braker arrangement if it is operated and then switched. Under these conditions, it is also important to care for dielectric stability.

It is known that the design of an embedded pole part has a cylinder shape form in order to fix the circuit breaker base. There is, however, no transition area, normally from a cylindric form directly to a square form at the bottom.

SUMMARY

An exemplary embodiment of the present disclosure provides an embedded pole part which includes an isolating housing made of thermoplastic material. The housing embeds a vacuum interrupter and electric terminals of the pole part. The housing includes, at an outer surface thereof, at least one of horizontal and vertical aligned three-dimensional structures joined by material engagement. The three-dimensional structures are implemented into the thermoplastic material to provide high mechanical stiffness and extend a creepage length of the pole part.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
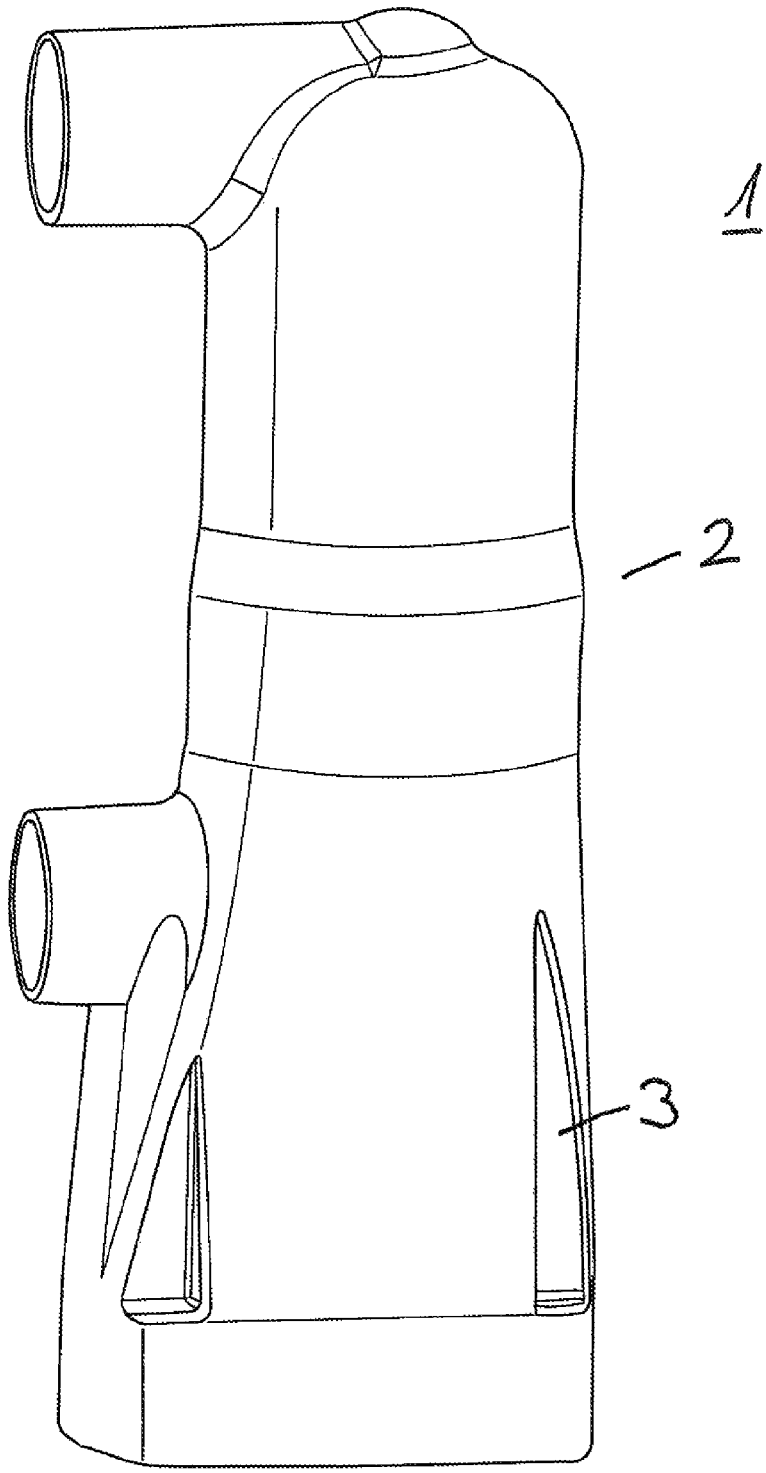
FIG. 1 illustrates a pole part according to an exemplary embodiment of the present disclosure.

Exemplary embodiments of the present disclosure provide an embedded pole part in which the mechanical and dielectric parameters of the pole part are strengthened as compared to known techniques, particularly in the case of a short circuit current, and also in each case of opening or closing the contact of a vacuum interrupter. Exemplary embodiments of the present disclosure provide an embedded pole part with an isolated housing made of a thermoplastic material, which embeds the vacuum interrupter as well as the electrical terminals of the pole part.

In accordance with an exemplary embodiment, at the outer surface of the housing, horizontal and/or vertical aligned 3-dimensional structures joined by material engagement are implemented into the thermoplastic material, in order to achieve a higher mechanical stiffness as well as higher creepage length of the pole part. The base area of the pole part is strengthened mechanically as well dielectrically in this arrangement.

In accordance with an exemplary embodiment, the housing is made of takes advantage of the features a of thermoplastic material, instead of duroplastic material (e.g., epoxy).

In accordance with an exemplary embodiment, the structures are implemented in such a way that the remaining wall-thickness of at least the base part of the isolating housing is uniform. The wall thickness could be implemented in all areas, at least at the bottom part of the pole part in a uniform wall thickness. In known techniques, the wall thickness especially of the bottom part is bigger, in order to strengthen the mechanical stiffness. By implementing the above mentioned structures, uniform wall thickness can be used. This causes saving of material without loss of mechanical stiffness and/or dielectric performance. This arrangement is technically advantageous.

In accordance with an exemplary embodiment of the present disclosure, the structures are L-shaped and/or U-shaped structures. This arrangement strengthens the mechanical as well as the dielectric parameters of the pole part.

In accordance with an exemplary embodiment of the present disclosure, the structures are placed in the lower region near to the lower electric terminal or near to the bottom of the pole part.

In accordance with an exemplary embodiment of the present disclosure, the L-shaped structures are aligned in an axial direction of the pole part.

In accordance with an exemplary embodiment of the present disclosure, the U-shaped structures are aligned perpendicular to the axial direction of the pole part.

In accordance with an exemplary embodiment of the present disclosure, several concentric ring-shaped structures are aligned and implemented into the housing around the lower terminal.

By this arrangement, the area around the lower contact terminal is mechanically very strong, but it has a symmetric arrangement of creep distance structures. This is effective and therefore advantageous to locate such a geometric structure there. Furthermore, the aforesaid structures can also be implemented in the coverage around the higher electric terminal.

In accordance with an exemplary embodiment of the present disclosure, horizontal rip-structures are aligned together, then geometrically superposed with vertical L-shaped structures at the bottom region under the lower terminal of the pole part. In this arrangement, the construction in the base area is optimized to achieve the optimal stiffness of the embedded pole and also mechanical strength for the embedded pole. The creepage distance is also optimized, because it is folded into this structure.

In accordance with an exemplary embodiment of the present disclosure, the pole part also has a smooth transition from cylinder (round) shape to the square base, without increasing the wall thickness.

This means that the wall thickness of the housing remains uniform, except for the 3-dimensional structures which are implemented. By the aforesaid structures, it is possible to prevent voids or inhomogenities in the thermoplastic material, since a uniform wall thickness can be realized easy, even under the condition of high mechanical withstand. That means, a uniform wall thickness can support a plastic material, free from voids.

In accordance with an exemplary embodiment of the present disclosure, the concentric structures have different depth from each other.

In accordance with an exemplary embodiment of the present disclosure, the concentric structures are closed or partly open ring structures. This means that the ring segments can be closed rings, or even only separate ring segments. In both cases, a creepage path extension is provided.

FIG. 1 shows a perspective view of an exemplary embodiment of an embedded pole part according to the present disclosure. The housing of the embedded pole part is denoted with reference symbol 1. At the base part of the pole part, under the lower electric terminal, there are L-shaped vertical (in an axial direction of the pole part) structures 3 implemented. They are implemented in an area which has a smooth transition 2 from a nearly round cylindric to a nearly squared cross section. The structures are placed in such a way that they end in the corners of the nearly squared cross section of the base part.

Figure 2:
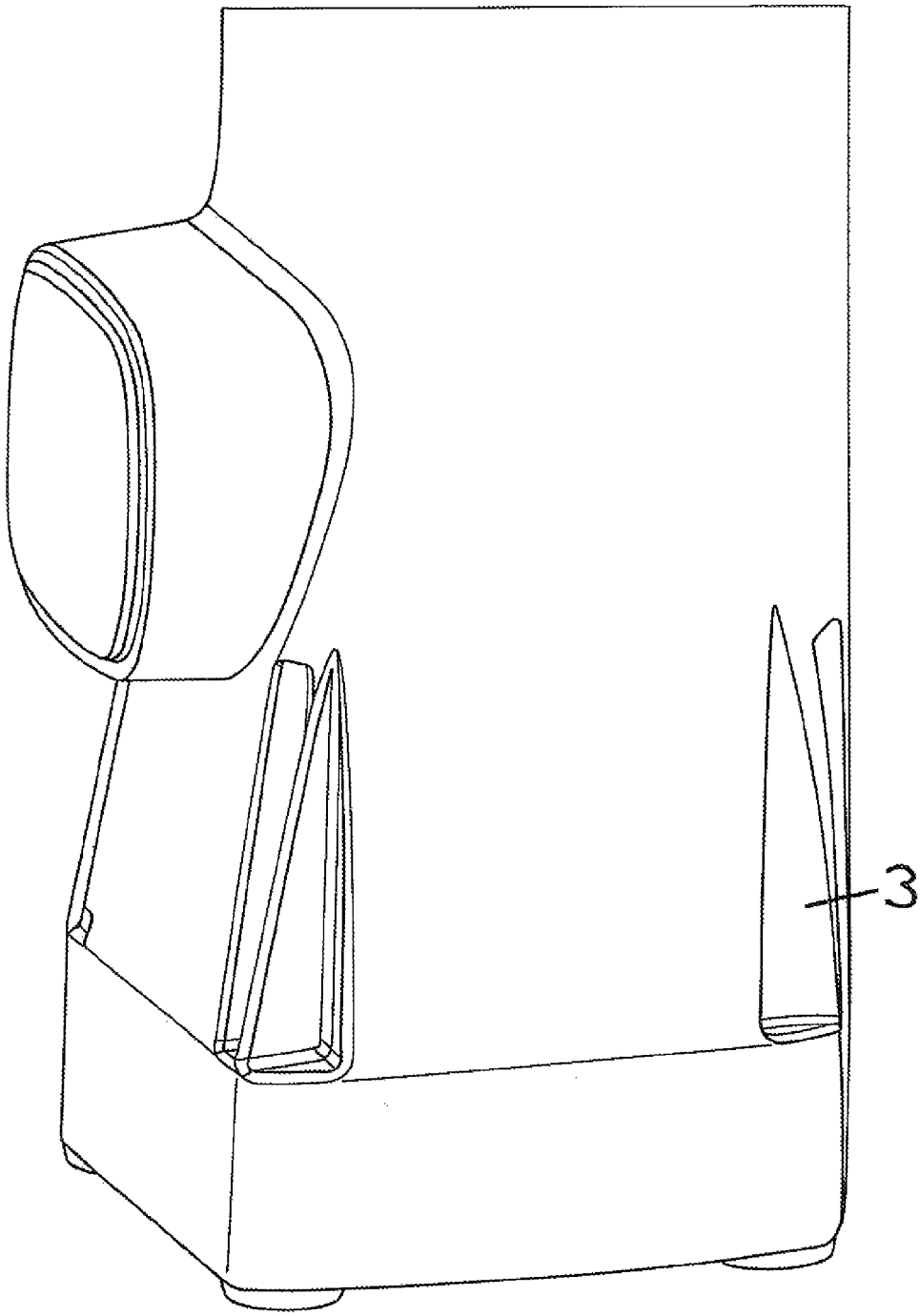
FIG. 2 illustrates in more detail the base of the pole part according to an exemplary embodiment of the present disclosure.

FIG. 2 illustrates in more detail the base of the pole part according to an exemplary embodiment of the present disclosure. FIG. 2 shows, in addition to FIG. 1, beneath the vertical L-shaped structures 3 a further vertical simple line structure is arranged.

This arrangement increases the mechanical stiffness.

Figure 3:
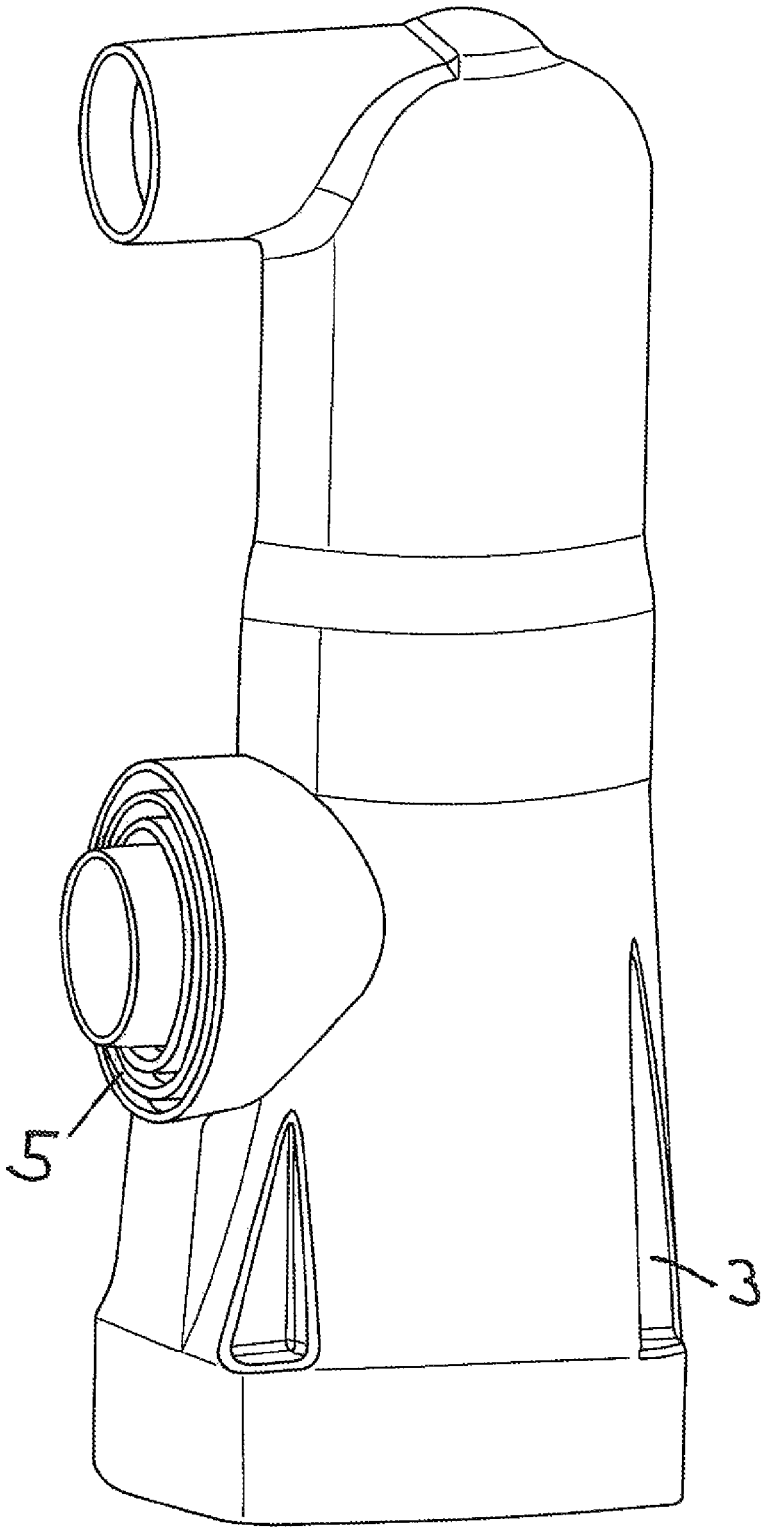
FIG. 3 illustrates a pole part with concentric structures according to an exemplary embodiment of the present disclosure.

FIG. 3 shows the base part of housing 1. L-shaped vertical structures 3 and U-shaped horizontal structures 5 are arranged in structural superposition under the lower electric terminal. This gives a very high performance in mechanical stiffness, as well as in high dielectric stability, because of extension of creepage path in this critical area.

Figure 4:
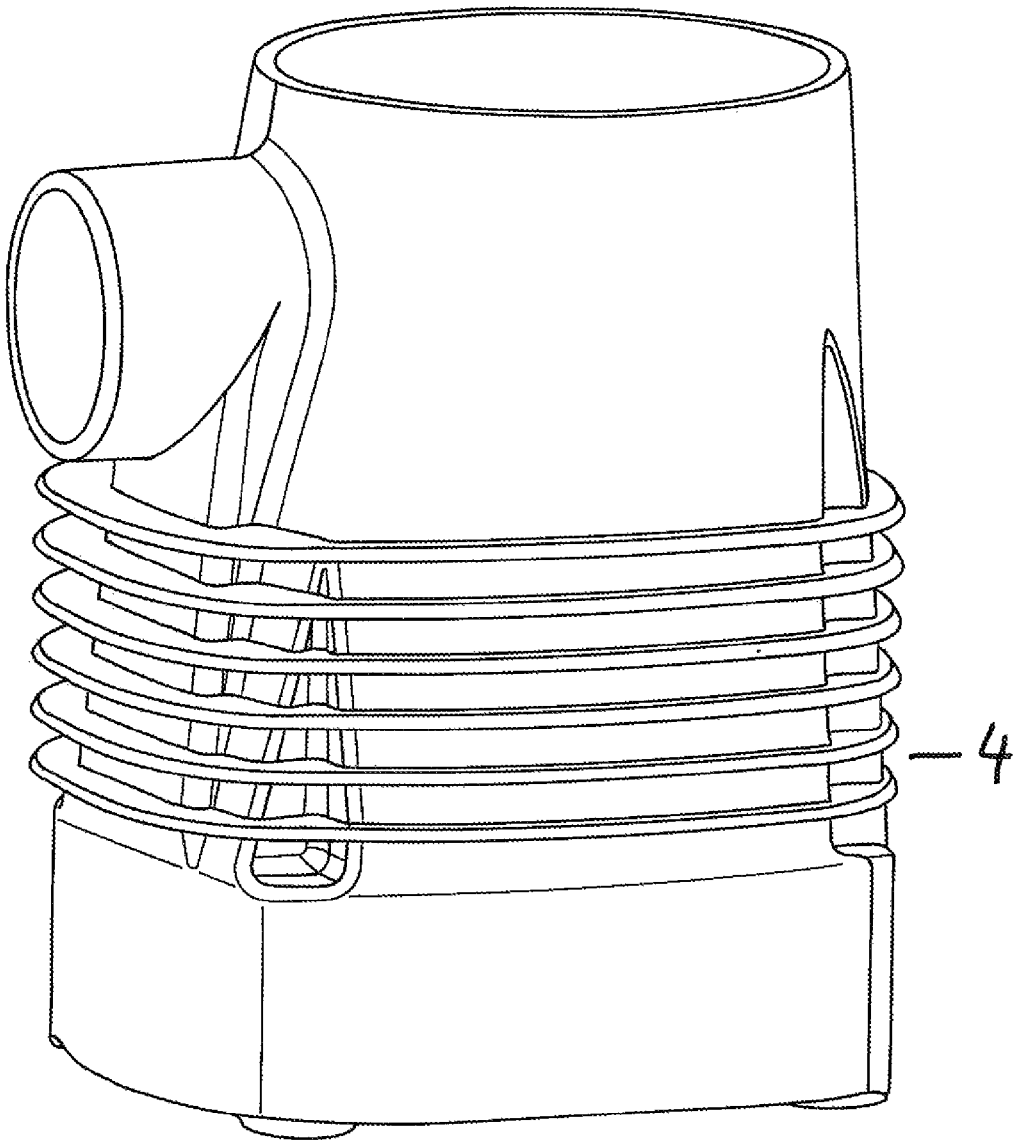
FIG. 4 illustrates a pole part with u-shaped structures at the bottom part according to an exemplary embodiment of the present disclosure.

FIG. 4 shows a pole part with a special structure at the lower electric terminal, in which structural lines 4 are arranged in a concentrical way. This arrangement also gives high mechanical resistivity as well an extension of the creepage path.

This structural arrangement can also be arranged at the higher electric terminal as well.

In all cases, that the above-described mechanical requirements are fitted to dielectric requirements in a cumulative way.

This is important, for example, for the feature of a uniform wall thickness in the area, in which the strengthening structures are implemented into the plastic housing. This area stands under mechanical stress during switching operation of the interrupter. Using a uniform wall thickness for thermoplastic material prevents the aforesaid voids. This fact furthermore supports the dielectric requirements. So it is a cumulative complex technical effect of the claimed features.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An embedded pole part comprising:

an isolating housing made of thermoplastic material, the housing embedding a vacuum interrupter and electric terminals of the pole part, wherein the housing includes, at an outer surface thereof, at least one of horizontal and vertical aligned three-dimensional structures joined by material engagement, the three-dimensional structures being implemented into the thermoplastic material to provide high mechanical stiffness and extend a creepage length of the pole part, and wherein the structures are arranged in a lower region near to at least one of a lower electric terminal and a bottom of the pole part, the structures are implemented in an area having a smooth transition from a nearly round cylindrical cross section to a nearly squared cross section, and the structures are arranged to end in corners of the nearly squared cross section of the base part of the isolating housing.

2. The embedded pole part according to claim 1, wherein the structures are implemented such that a remaining wall-thickness of at least the base part of the isolating housing is substantially uniform.

3. The embedded pole part according to claim 1, wherein at least part of at least one of the structures is at least one of L-shaped, U-shaped and rib-shaped.

4. The embedded pole part according to claim 3, wherein the L-shaped structures are aligned in an axial direction of the pole part.

5. The embedded pole part according to claim 3, wherein the U-shaped structures are aligned perpendicular to an axial direction of the pole part.

6. The embedded pole part according to claim 1, comprising: a plurality of concentric ring-shaped structures aligned and implemented in the housing around at least one of a lower electric terminal and a higher electric terminal of the pole part.

7. The embedded pole part according to claim 1, comprising: rib-structures aligned together and geometrically superposed with the vertical L-shaped structures in a bottom region under a lower electric terminal of the pole part.

8. The embedded pole part according to claim 6, wherein the rib structures are limited in length such that the rib structures end in at least one of a front structure and a side structure of the housing.

9. The embedded pole part according to claim 6, wherein the concentric structures have different depths than each other.

10. The embedded pole part according to claim 6, wherein the concentric structures are each respectively one of closed ring structures and partly open ring structures.

11. The embedded pole part according to claim 4, wherein the U-shaped structures are aligned perpendicular to the axial direction of the pole part.

12. The embedded pole part according to claim 7, wherein the rib structures are limited in length such that the rib structures end in at least one of a front structure and a side structure of the housing.

13. The embedded pole part according to claim 7, wherein the concentric structures have different depths than each other.

14. The embedded pole part according to claim 6, wherein the rib-structures are aligned together and geometrically superposed with the vertical L-shaped structures in a bottom region under a lower electric terminal of the pole part.

15. The embedded pole part according to claim 7, wherein the concentric structures are each respectively one of closed ring structures and partly open ring structures.

16. The embedded pole part according to claim 9, wherein the concentric structures are each respectively one of closed ring structures and partly open ring structures.

17. The embedded pole part according to claim 2, wherein at least part of at least one of the structures is at least one of L-shaped, U-shaped and rib-shaped.

18. The embedded pole part according to claim 17, wherein the structures are arranged in a lower region near to at least one of a lower electric terminal and a bottom of the pole part.

19. The embedded pole part according to claim 18, wherein the L-shaped structures are aligned in an axial direction of the pole part.

20. The embedded pole part according to claim 19, wherein the U-shaped structures are aligned perpendicular to the axial direction of the pole part.

21. The embedded pole part according to claim 2, comprising:

a plurality of concentric ring-shaped structures aligned and implemented in the housing around at least one of a lower electric terminal and a higher electric terminal of the pole part.

22. The embedded pole part according to claim 21, wherein the rib-structures aligned together and geometrically superposed with the vertical L-shaped structures in a bottom region under the lower electric terminal of the pole part.

23. The embedded pole part according to claim 22, wherein the rib structures are limited in length such that the rib structures end in at least one of a front structure and a side structure of the housing.

24. The embedded pole part according to claim 22, wherein the concentric structures have different depths than each other.

25. The embedded pole part according to claim 22, wherein the concentric structures are each respectively one of closed ring structures and partly open ring structures.

* * * * *